United States Patent [19]

Olsen et al.

[11] Patent Number: 5,020,641

[45] Date of Patent: Jun. 4, 1991

[54] METHOD AND APPARATUS FOR ERECTING HYDRAULIC ELEVATOR RAILS

[75] Inventors: J. H. Olsen, Pearl River, N.Y.; Thomas L. Harvey, Ownings; Mark J. Cornett, Waldorf, both of Md.; Demetre Galatis, Springfield, Va.

[73] Assignee: Otis Elevator Company, Farmington, Conn.

[21] Appl. No.: 541,003

[22] Filed: Jun. 20, 1990

[51] Int. Cl.[5] ..... B66B 7/02

[52] U.S. Cl. ..... 187/95; 187/1 R

[58] Field of Search ..... 187/1 R, 95

[56] References Cited

U.S. PATENT DOCUMENTS

| | | | |
|---|---|---|---|
| 288,352 | 11/1883 | Low . | |
| 1,907,967 | 5/1933 | Himes | 187/1 R |
| 2,246,732 | 6/1991 | Hymans | 187/1 R |
| 3,252,547 | 5/1966 | Hornedo | 187/95 X |
| 3,851,736 | 12/1974 | Westlake et al. | 187/95 |
| 4,095,677 | 6/1978 | Johannson | 187/17 |
| 4,793,441 | 12/1988 | Cilderman et al. | 187/95 |

FOREIGN PATENT DOCUMENTS

WO89/04807 6/1989 World Int. Prop. O. .

*Primary Examiner*—Robert P. Olszewski
*Assistant Examiner*—Dean A. Reichard
*Attorney, Agent, or Firm*—Lloyd D. Doigan

[57] ABSTRACT

A method and an apparatus for mounting rail sections, which guide an hydraulic elevator in a hoistway, utilizes a platform which is driven upwardly and downwardly from below, and a segmented stile attaching to the platform, the stile extending a given height above the platform to allow access to joints connecting said rail sections, the segmented stile guiding the platform along the rail sections during the erection of the rails.

16 Claims, 2 Drawing Sheets

METHOD AND APPARATUS FOR ERECTING HYDRAULIC ELEVATOR RAILS

DESCRIPTION

1. Background Art

Hydraulic elevator cars are guided upwardly and downwardly by rails mounted within a hoistway. Each rail is comprised of a plurality of rail sections attached one on top of another. The rails are mounted by brackets to the hoistway structure. Such structure may include divider beams which separate adjacent hoistways.

To initiate the mounting of the rails, scaffolding is erected within the hoistway, sections of rail are disposed in the bottom of the hoistway, and a winch or pulley, or the like, for hoisting each rail section is disposed at the top of the hoistway.

The brackets are set in the hoistway structure. Workers then bracket a first section of the rail to the bottom of the hoistway and work upwardly, mounting one rail on top of the previously mounted rail. The pulley is used to lift and position a rail section on top of a bracketed rail section. Each section of rail is attached to another section of rail by means of a fishplate. To set brackets, to bracket each rail section to the hoistway structure, and to place one section of rail on top of another section of rail, workers either work off the scaffolding or utilize ladders which extend from the scaffolding. Working with heavy rails on scaffolding and ladders requires sufficient care to be taken (particularly in adverse weather conditions). As a result, the mounting of the rails to the top of the hoistway is very time consuming.

2. Disclosure of the Invention

It is an object of the invention to quickly and safely install rails for a hydraulic elevator.

According to the invention, a method for mounting rails which guide an hydraulic elevator in a hoistway, the rails being comprised of a plurality of sections one mounted on top of another, the sections being connected together at joints therebetween, comprises the steps of; mounting a bottom section of rail to said hoistway, installing a truncated car in the hoistway, the truncated car having a floor and a segmented stile extending a height above the floor sufficient to allow access to the joints connecting the rail sections so that the floor may be used as a working platform, elevating the truncated car, attaching sections of the rail to previously mounted sections of rail at the joints above said segmented stile. The segmented stile allows workers to work on the platform without having prior art elevator cab support structure interfere with the erection of the rails.

According to a feature of the invention, the truncated car utilizing a segmented stile may be used to align the rails vertically and to each other.

According further to the invention, an apparatus for mounting rail sections, which guide an hydraulic elevator in a hoistway, is comprised of a platform which is driven upwardly and downwardly from below, and a segmented stile attaching to the platform, the stile extending a given height above the platform to allow access to joints connecting said rail sections, the segmented stile guiding the platform along the rail sections.

These and other objects, features and advantages of the present invention will become more apparent in light of the following detailed description of a best mode embodiment thereof, as illustrated in the accompanying drawings.

BEST MODE FOR CARRYING OUT THE INVENTION

Figure 1:
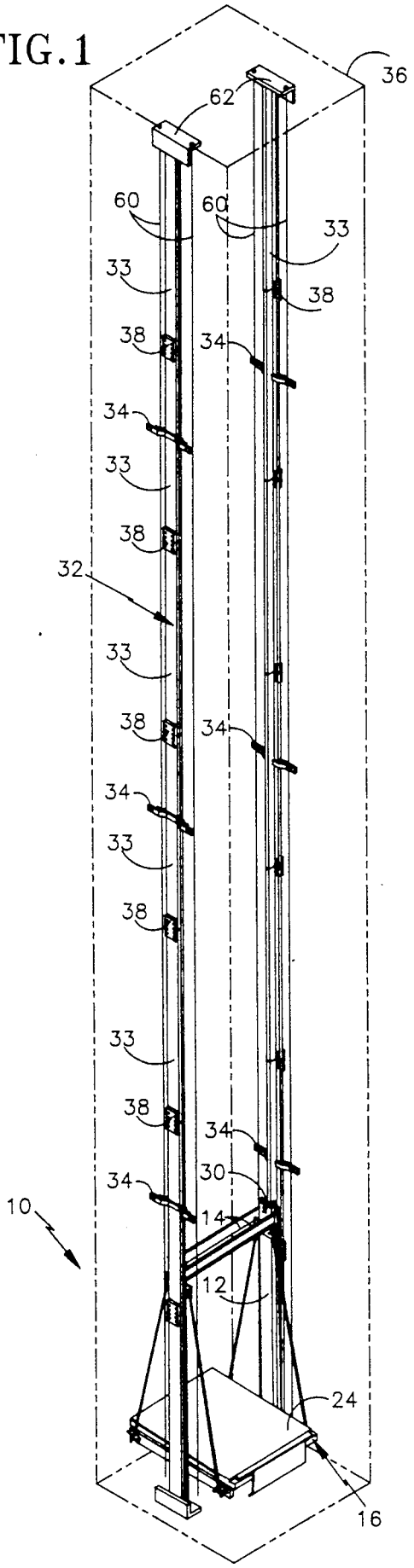
FIG. 1 is a perspective view of prior art hydraulic elevator support.

Referring to FIG. 1, a prior art hydraulic elevator "truncated car" 10 is shown. The truncated car is comprised of a pair of vertical stiles 12 which are connected by a pair of cross beams 14 and a bolster frame 16. The frame is comprised of two side pieces 18, a front piece 20 and a back piece 22 (see FIG. 2). Each side piece 18 connects at a first end thereof to a front piece 20 and at a second end thereof to a rear piece 22. Each side piece connects, as is known in the art to a stile 12. A platform 24 for supporting an elevator cab (not shown) is disposed upon the frame. A piston 26 of a hydraulic cylinder 28 is attached to the platform and frame (see FIG. 3) as is known in the art.

At a first portion of a stile 12, below the platform 24, and at a second portion of each stile, in the vicinity of the crossbeams 14, a slider guide 30, or roller guide, is mounted. The slider guide guides the stiles (and hence the elevator cab which is mounted on the platform) on the rails 32.

The rails 32 are segmented into 16 foot sections 33 which are stacked end to end and are mounted by brackets 34 to the hoistway structure 36. The sections are connected by fishplates 38, as is known in the art. The fishplates ensure that the rail sections are properly aligned to each abutting rail section.

The rails sections are hoisted one above an other by means of a pulley 40 (see FIG. 3) or the like. Workers then attach the rail sections to each abutting rail section and to the brackets.

Figure 2:
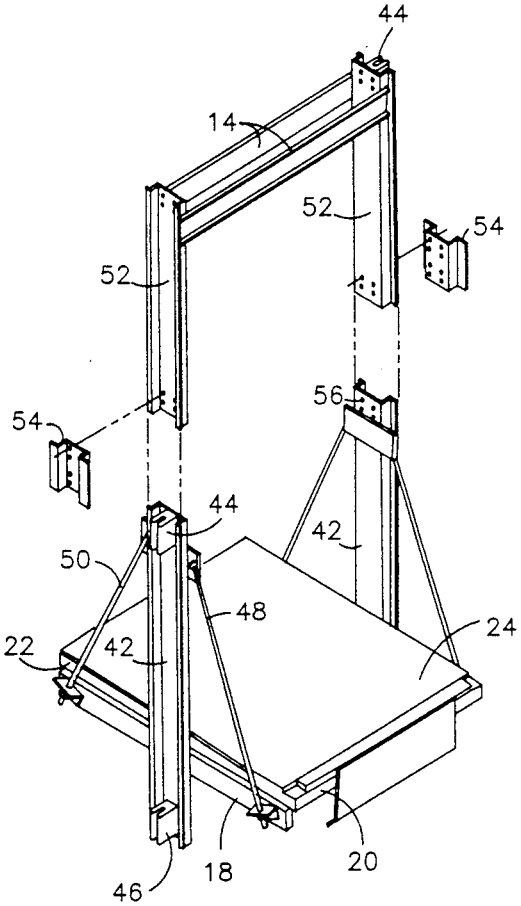
FIG. 2 is a hydraulic elevator car support incorporating an embodiment of the invention.

Referring to FIG. 2, an embodiment of the invention for erecting elevator rails is shown. A first stile section 42 attaches to the side support and extends a convenient working height above the platform, about 27 inches. A first slider guide 44 is attached to a top portion of the first stile section by bolts (not shown), or the like, and a second slider guide 46 is attached to a bottom portion of the first stile section by bolts (not shown), or the like, below the horizon of the platform. A first brace rod 48 attaches at a first end portion thereof to a first end portion of side support and at a second end portion thereof to the first stile section. Similarly, a second brace rod 50 attaches at a first end portion thereof to a second end portion of side support and at a second end portion thereof to the first stile section. The brace rods provide added stability and minimize the probability that the platform tilts.

After the rails 32 are mounted to the hoistway structure 36, as will be discussed infra, an upper, second stile section 52 is attached by bolts (not shown), or other suitable means, to the first stile section 42 by means of a second fishplate 54, which has a U-shaped cross section. The fishplate 54 may be attached to holes 56 in the first stile section which receive bolts to hold the first slider guide 44. The connected first and second stile sections extend to the length of a prior art stile as shown in FIG.

1. The crossbeams 14 may then be attached conventionally to the second stile sections. The second stile sections and the cross beams allow an elevator cab to be placed and properly supported on the platform. One of ordinary skill in the art will recognize that the appropriate additions (i.e. second stiles, cross beams or other supports) may be made to the first stile sections to support a cab or the like without departing from the teachings and scope of this invention.

Figure 3:
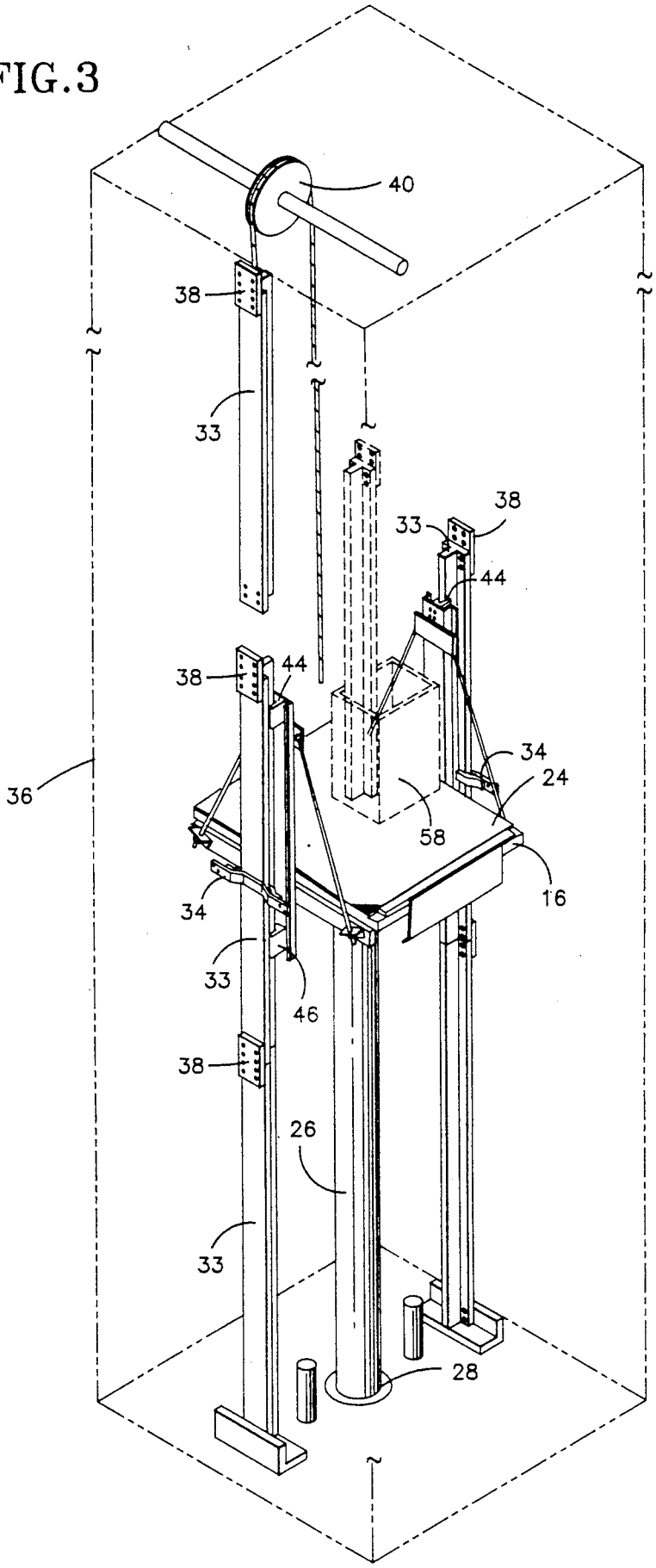
FIG. 3 is a perspective view partly broken away of a hydraulic elevator car support during rail erection.

To mount the rail sections 33 to the hoistway structure 36, the following procedure, as shown in FIG. 3 is followed. A pair of rail sections 33 and the brackets 34 therefor are mounted in the bottom of the hoistway. The bolster frame 16, the first stile sections 42, and the platform 24 are installed within the previously erected rails. The bolster frame is connected conventionally to the hydraulic piston 26. The slider guides 44 at the top of the first stile section 42 are temporarily installed. The slider guide 46 at the bottom of the first stile section may be permanently installed. In essence, the truncated car for use as a working platform is complete.

A second section 33 of rail is then winched into place and attached to the bottom most section of rail by a fishplate 38. The rail section may be pulled up from the bottom of the shaft or may be carried up with the platform 24 in a box 58 (as shown in phantom in FIG. 3), or the like. Workers may attach the second section of rail while working from the platform 24. The truncated car is then raised to a position where the second section of rail may be bracketed to the building while the slider guides 44, 46 guide the truncated car along the rails in the hoistway. Workers attach the rails to brackets as is necessary until another section of rail is attached by means of a first fishplate. Construction continues as above until the last rail is installed. Ladders may be necessary on the last section of the rail because the height of travel of the car is limited by the length of the piston. By using such a method, the time required to erect the rails is minimized.

The platform may be used to align the rails using an offset or a two line system. Typically a pair of gauge wires 60 are dropped plumb from a bracket 62 which extends to either side of the top of each of the rails (see FIG. 1). The wires are secured by conventional means to the bottom of the hoistway. The rails 32 may be aligned vertically by comparing the position of the rail sections 33 to the wires 60 on either side thereof. The rails may also be aligned relative to each other by comparing the position of the wires on one side of the truncated car with the wires disposed on the other side of the truncated car. The rails may be adjusted within the brackets 34 as is known in the art. By utilizing the truncated car, the rails may be properly aligned vertically and to each other in a minimum amount of time.

Upon completion of the erection and the alignment of the rails, the upper support section comprising the second stile sections 52 and the crossbeams 14 are attached to the first stile sections 42 by means of the fishplates 54, and the slider guides 44 are moved from first stile sections 42 to second stile sections 56 (see FIG. 2).

Although the invention has been shown and described with respect to a best mode embodiment thereof, it should be understood by those skilled in the art that the foregoing and various other changes, omissions, and additions and the form and detail thereof may be made therein without departing from the spirit and scope of the invention.

We claim:

1. A method for mounting rails which guide an hydraulic elevator in a hoistway, the rails being comprised of a plurality of sections one mounted on top of another, the sections being connected together at joints thereof, the method comprising the steps of:

mounting a bottom section of rail to said hoistway, installing a truncated car in said hoistway, said truncated car having a floor and a segmented stile extending a height above a floor of the truncated car sufficient to allow access to the joints connecting said rail sections such that said floor acts as a working platform, elevating said truncated car, attaching sections of said rail to previously mounted sections of rail at said joints above said segmented stile.

2. The method of claim 1 including the further step of:

attaching said sections of rail to said hoistway.

3. The method of claim 2 including the further step of:

utilizing said truncated car to align said rails.

4. The method of claim 1 including the further step of:

attaching an upper support section to said stile for supporting and guiding an elevator cab upon said platform.

5. A method for mounting rails which guide an hydraulic elevator in a hoistway, the rails being comprised of a plurality of sections one mounted on top of another, the sections being connected together at joints thereof, the method comprising the steps of:

a. mounting a bottom section of rail to said hoistway, b. installing a truncated car in said hoistway, said truncated car having a floor and a segmented stile extending a height above a floor of the truncated car sufficient to allow access to the joints connecting said rail sections such that said floor acts as a working platform, c. elevating said truncated car, d. attaching sections of said rail to previously mounted sections of rail at said joints above said segmented stile, e. attaching said sections of rail to said hoistway, and f. repeating steps c through e until the rail erection is complete.

6. The method of claim 5 including the further step of:

g. utilizing said truncated car to align said rails.

7. The method of claim 5 including the further step of:

attaching an upper support section to said stile for supporting and guiding an elevator cab upon said platform.

8. A method for mounting rails which guide an hydraulic elevator in a hoistway, the rails being comprised of a plurality of sections one mounted on top of another, the sections being connected together at joints thereof, the method comprising the steps of:

mounting a bottom section of rail to said hoistway, installing a truncated car in said hoistway, said truncated car having a floor and a segmented stile extending a height above a floor of the truncated car sufficient to allow access to the joints connecting said rail sections such that said floor acts as a working platform, elevating said truncated car, hoisting a section of rail on top of said bottom section of rail, attaching said section of rail to said bottom section of rail at said joints above said segmented stile, elevating said truncated car, and attaching said sections of rail to said hoistway.

9. The method of claim 8 including the further step of:

utilizing said truncated car to align said rails.

10. The method of claim 8 including the further step of:

attaching an upper section to said stile for supporting said guiding an elevator cab upon said platform.

11. An apparatus for mounting rails which guide an elevator in a hoistway, the elevator being driven by a piston, the rails being comprised of a plurality of sections one mounted on top of another, the sections being connected together at joints thereof, the apparatus comprising:

a platform attaching to said piston, a segmented stile attaching to said platform, said stile extending a height above said platform sufficient to allow access to the joints connecting said rail sections, means attaching to said stile for guiding said stile and said platform along said rails, and an upper support structure attaching to said stile for receiving an elevator cab.

12. The apparatus of claim 11 wherein said means attaching to said stile comprises:

a first guide attaching to said stile above said platform, and a second guide attaching to a portion of said stile extending below said platform.

13. The apparatus of claim 11 further comprising:

support means attaching to said stile and said platform for stabilizing said platform.

14. An apparatus for mounting rails which guide an elevator in a hoistway, the elevator being driven by a piston, the rails being comprised of a plurality of sections one mounted on top of another, the sections being connected together at joints thereof, the apparatus comprising:

a platform attaching to said piston, a segmented stile means attaching to said platform for guiding said platform along said rails, said stile means extending a height above a platform sufficient to allow access to the joints connecting said rail sections, and an upper support structure attaching to said stile means for receiving an elevator cab.

15. The apparatus of claim 14 wherein said stile means further comprises:

a first guide attaching to said stile means above said platform, and a second guide attaching to a portion of said stile means extending below said platform.

16. The apparatus of claim 14 further comprising:

support means attaching to said stile means and said platform for stabilizing said platform.

* * * * *